US005998752A

United States Patent [19]

Barton et al.

[11] Patent Number: 5,998,752

[45] Date of Patent: Dec. 7, 1999

[54] SORTING SYSTEM

[75] Inventors: Paul Barton, Malmesbury; John Maurice Bartlett, Swindon, both of United Kingdom

[73] Assignee: the Post Office, Croydon, United Kingdom

[21] Appl. No.: 09/042,468

[22] Filed: Mar. 16, 1998

[30] Foreign Application Priority Data

Mar. 17, 1997 [GB] United Kingdom ..... 9705474
Dec. 2, 1997 [GB] United Kingdom ..... 9725527

[51] Int. Cl.[6] ..... B07C 5/00

[52] U.S. Cl. ..... 209/583; 209/584; 209/900; 235/425; 235/462.12

[58] Field of Search ..... 209/900, 556, 209/559, 577, 583, 584; 235/462.12, 425

[56] References Cited

U.S. PATENT DOCUMENTS 5,072,400 12/1991 Manduley .

FOREIGN PATENT DOCUMENTS 0 227 569 1/1987 European Pat. Off. .
0 494 814 A1 7/1992 European Pat. Off. .
195 20 057 A1 12/1996 Germany .
WO 90/12660 11/1990 WIPO .

*Primary Examiner*—Donald P. Walsh
*Assistant Examiner*—Brett C. Martin
*Attorney, Agent, or Firm*—Larson & Taylor

[57] ABSTRACT

There is disclosed a sorting system, relying on the identification of items to be sorted by means of codes applied thereto, in which it is possible to infer the identity of items whose codes have become unreadable. The system relies on identifying the item by reference to the codes of items which precede and which follow the item.

13 Claims, 3 Drawing Sheets

SORTING SYSTEM

This invention relates to a sorting system, and in particular to a system which allows tracing of items therein.

In one conventional mail sorting system, within a sorting office, codes, known as "tag codes" are printed on some items of mail. These codes take the form of printed bar codes, which uniquely identify the item, and allow information about that item to be stored in, and retrieved from, a database. In such a system, the address information is normally read electronically by optical character recognition, and used to generate a machine readable routing code, which is then used by the sorting system. If the OCR process is unable to capture the necessary information, it is necessary to enter the information manually, and a tag code can then be applied to the item to link an item to the manually entered information. The tag code can be read in a subsequent process, and the manually entered address information, associated with that item, can be used to form the routing code.

One disadvantage of this system is that the ability to read printed bar codes is less than 100%, for example because of damage to the item, or smearing of the ink during printing.

Moreover, there is a problem in that the sequence in which items are presented to sorting stations may change, for example because of errors in handling items.

According to a first aspect of the present invention, there is provided a sorting system including a plurality of sorting-stations, the system comprising means for applying a code to each item; means for storing information relating to the sorting station to which each item is sent; and means for identifying an item, the code on which has been found to be unreadable at a sorting station, using the stored information relating to the items sent to that station.

According to a second aspect of the present invention, there is provided a method of sorting items, comprising applying a code to each item; storing information regarding the destinations of each item in the system; and, when a code on an item is found to be unreadable, determining the code by tracing which items have been sent to the station.

For a better understanding of the present invention, and to show how it may be put into effect, reference will now be made, by way of example, to the accompanying drawings, in which.

Figure 1:
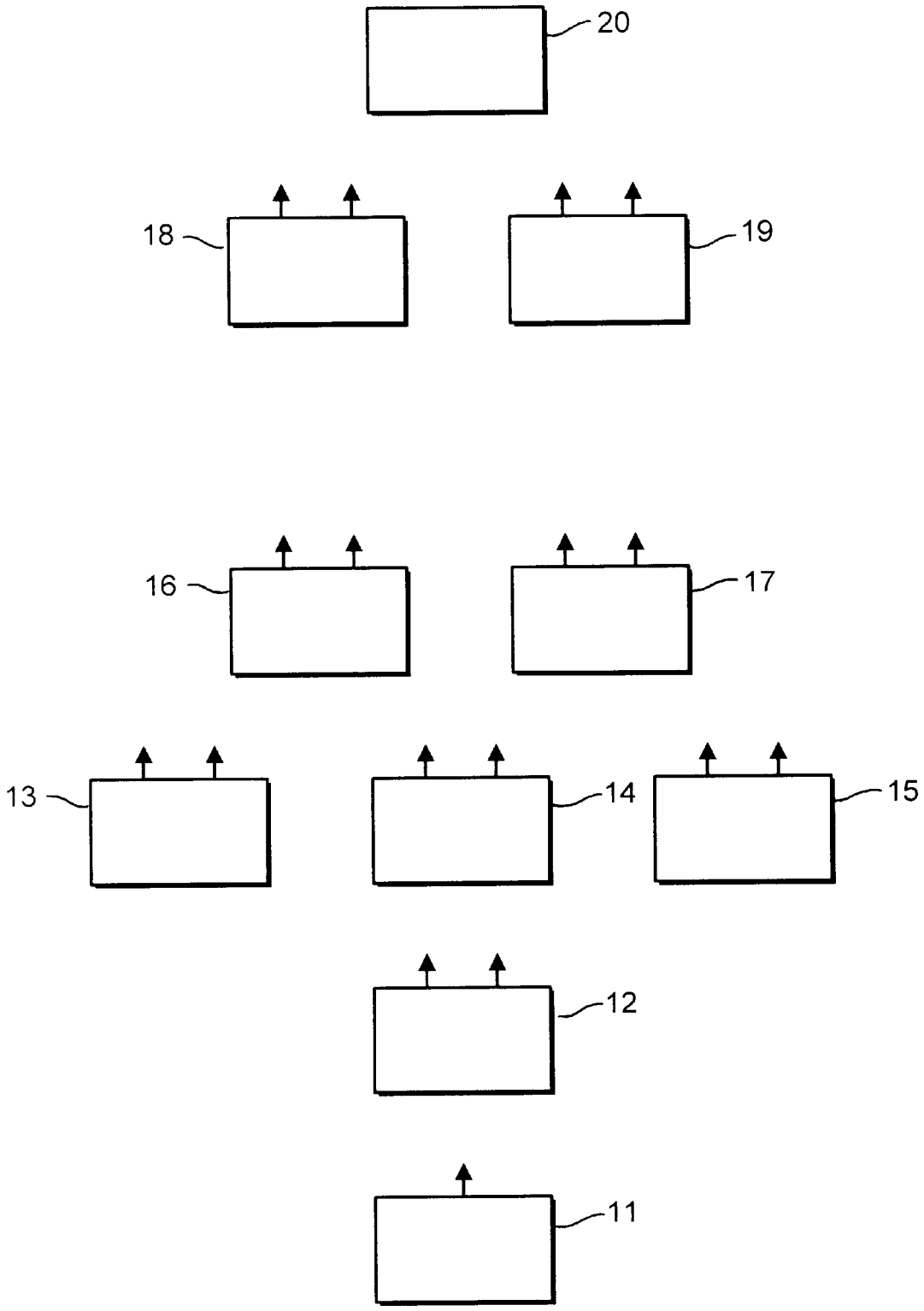
FIG. 1 is a schematic illustration of a sorting system in accordance with the invention.

FIG. 1 is a schematic illustration of a mail sorting room, comprising a number of sorting stations 11–20. The general nature of these stations will be well known to a person familiar with this technical field. For example, these sorting stations will include an optical character recognition station for determination of address information, different sorting stations relating to different sizes of items, and different packaging stations, as well as a final loading bay. The term "sorting stations" as used herein also refers to other types of station within a mail sorting office, even where no sorting takes place at those locations, for example to a holding area where lower priority items are stored to await a less busy time at which they can be processed. It will also be appreciated that the description of mail sorting is only illustrative, and that the invention may be applied to any context where items are sorted and routed through a system.

The intended destination of a mail item, and its character, for example whether it is to be given a standard class of service, or a premium service, whether it is a letter or a parcel, and whether it is intended for inland or overseas carriage, will determine its intended progress through the sorting office. For example, an item may be intended to pass from station 11, to station 12, to station 13, to station 17, to station 19, to station 20. A different item may be intended to pass from station 11, to station 12, to station 15, to station 18, to station 20.

In accordance with the invention, station 11 includes a device, for applying a code, for example a conventional bar code, to the item. The device may for example be a printing device, or may apply a coded label. Station 11, and the other stations 12–20, are connected to a central computer (not shown), including a database.

As an alternative to, or in addition to, a central computer, the system may include networked processing and storage means at each sorting station.

Each sorting station may make a decision, regarding each item passing therethrough, as to the next station to which that item is to be sent. This decision may be made on the basis of information obtained at the station itself, or may be made wholly or partly on the basis of information obtained at an earlier sorting station. For example, it may be determined at one sorting station that an item is to be handled in a particular way, and information regarding that future handling may be stored in the system database mentioned above in association with the code applied to the item so that, when the item reaches future sorting stations, and is identified at those sorting stations, those sorting stations are able to retrieve information regarding the intended handling of the item. After processing at a sorting station, in accordance with the invention, information regarding the handling of the item, for example relating to the next sorting station to which the item is sent, is stored in the database, in association with the code which has been applied to the item. This allows the computer to determine an expected sequence of items to be received at each station. In the event that a station is unable to interpret a code on an item which it receives, a query signal is sent to the computer, containing details of the previously received items and the subsequently received items, allowing a determination to be made as to the code which should be present on the items whose code is unreadable.

In a preferred alternative, additional information may be stored in the database regarding the item, for example the size of the item or the desired class of service. When a station then fails to identify a code, that additional information can be sent to the database as a cross-check that the proposed code is indeed correctly associated with an item matching that information.

Figure 2:
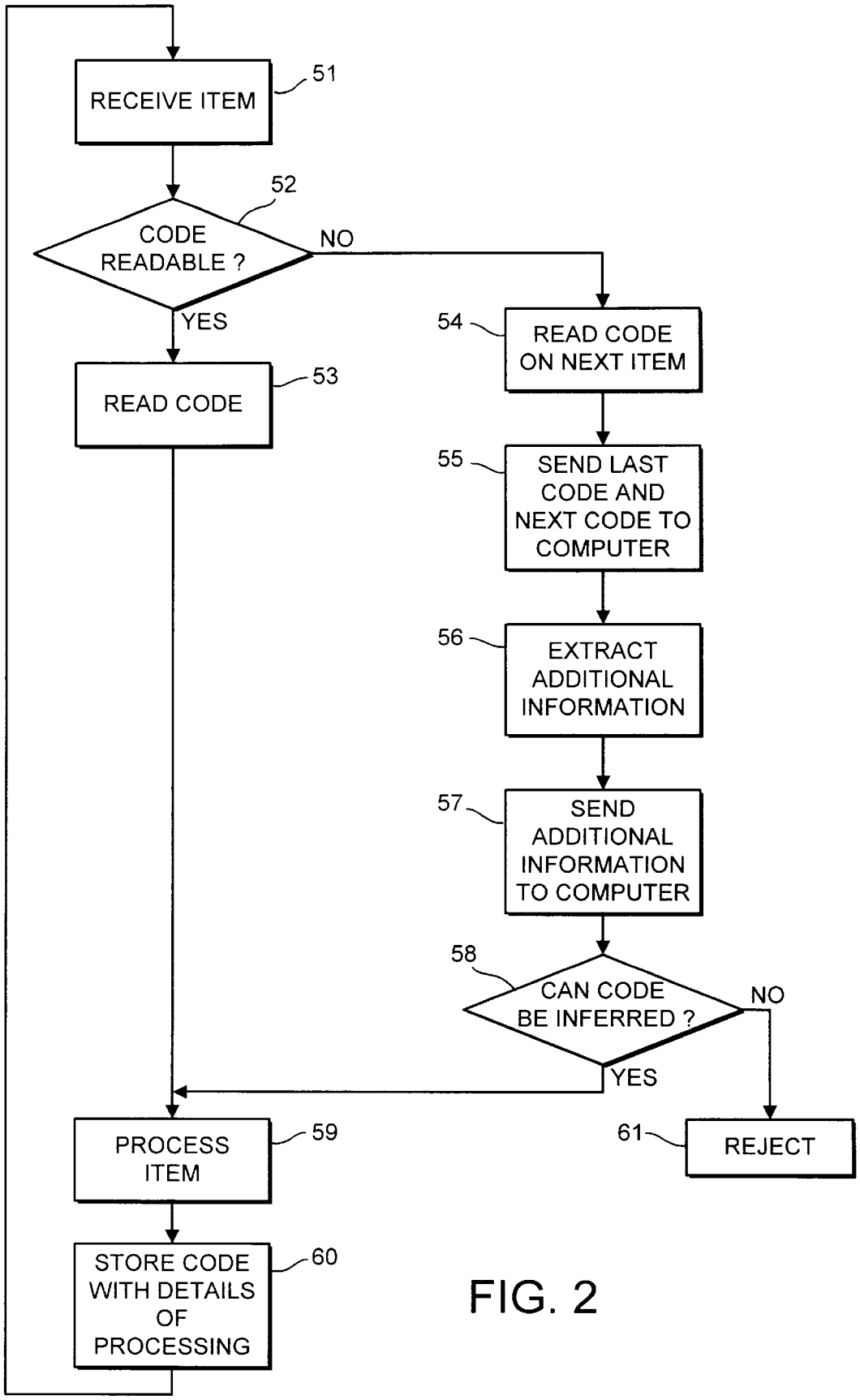
FIG. 2 is a flow chart illustrating a data recovery process.

FIG. 2 is a flow chart showing the process carried out at a sorting station when it fails to read a code.

In step 51, an item is received at a sorting station. That item will have had a code, for example in the form of a printed bar code which uniquely identifies the item, applied thereto at an earlier stage in its processing. The central database might perhaps contain an indication of the weight of the item, the payment made for its handling, and whether it is intended for inland or overseas delivery. These factors may need to be known by each sorting station, so that they can determine how to handle the item, for example which subsequent sorting station should receive the item. This information can be accessed from the central database by referring to the code on the item. The central computer database will also store address information associated with that item. The address information may have been obtained either by an optical character recognition process, or by manual input if the destination address on the item is not machine readable.

After receiving the item, therefore, the sorting station determines whether the printed code, applied thereto, is readable. In probably at least 99 of cases, the code will be readable, and the process will pass to step 53, where the code is read.

However, if the code is not readable, for example because the ink became smeared, or because it was applied to an item whose surface was not exactly flat, the process passes to step 54. In step 54, the sorting station reads the code on the next item which is to be processed. Then, in step 55, that code read from the next item, and the previously read code from the preceding item are transmitted to the central computer. In addition, in step 56, the sorting station may extract additional information from the item, for example the size of the item or any other piece of information which has previously been extracted in respect of all items. In step 57, that additional information is sent to the central computer.

On receipt of the codes sent in step 55, and the additional information sent in step 57, the computer attempts to infer the code which was found to be unreadable by looking at the sequence of items expected at that station. This will be possible because each sorting station, when handling an item, stores, at the central computer, details of the processing applied to the item, together with its code. As a relevant detail of the processing, for example, might be stored the next sorting station to which the item is sent. By attaching a sequential identifier to each piece of data indicating that a particular item has been sent to a particular sorting station, or by creating a database associated with each sorting station for storing the details of items sent to that sorting station, the computer will be able to recreate the sequence of items which has been sent to any one sorting station, and so it should be possible to determine the code of any item whose code is in fact unreadable when it reaches that sorting station. At step 58, it is determined whether the code can in fact be inferred with confidence. If the inference can been made by the computer, the information is transmitted back to the sorting station.

It will be appreciated that the inference is not limited to that described above. The system may also be able to infer the codes of a group of consecutive items, from the codes of the items at either end of that group. Alternatively, the inference may use only the codes of items before the item with the unreadable code.

As described so far, the system is able to infer the unreadable codes which have been applied to items by using the sequence in which the items are expected to arrive at a particular sorting station. However, there is also the possibility that items will arrive out of their expected sequence. For example, items may simply be mishandled for some reason, or a stack of items may be incorrectly reassembled after machinery has become jammed. If an unreadable code appears on an item at a time when the expected sequence of items has been disrupted, it becomes slightly more difficult to identify the item. However, it is still possible to infer an unreadable code, in particular by examining the readable codes of more of the surrounding items, assuming that the surrounding items arrive in the expected sequence, and/or by using additional identifying information about the item.

For example, in order to achieve this, a process may be used which is generally similar to that shown in the flow chart of FIG. 2, but in which, in steps 54 and 55, additional codes are sent to the computer. The greater the number of codes sent, the higher the probability that it will be possible to identify an item which has appeared out of sequence, but of course this benefit must be weighed against the increased storage and processing capacity needed to deal with greater numbers of codes, in determining the appropriate number of codes to send. In a situation in which items are expected to appear out of sequence only rarely, and the disruption of the sequence is expected to be small even then, it may be most advantageous to send the code of the one item immediately preceding and the two items immediately following the item with the unreadable code.

Figure 3:
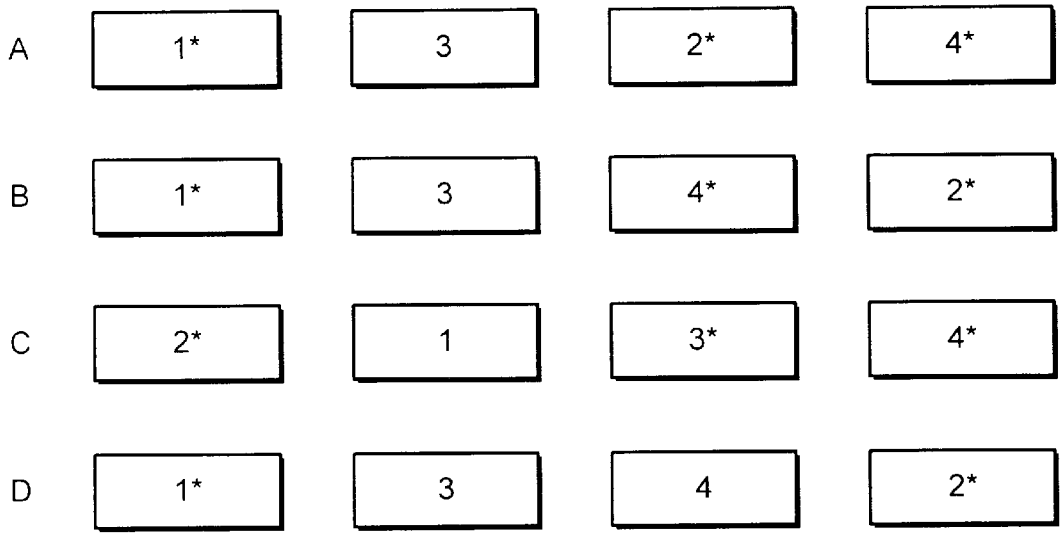
FIG. 3 illustrates the way in which, in accordance with the invention, unread codes can be inferred even when items appear out of sequence at a station.

FIG. 3 shows some examples of sequences of codes which might be read and inferred in accordance with the invention. In FIG. 3, the rectangular boxes represent items appearing at a sorting station, with the first box at the left side, the digits represent the position of the item within an expected sequence of items, and an asterisk following the digit indicates that the code of that item has been successfully read.

In line A of FIG. 3, following the successful reading of the code of item 1, the next code is unreadable. By subsequently successfully reading the codes of items 2 and 4, it is possible to infer that the item with the unread code is item 3, even though it has appeared out of sequence at the station, because the expected code of item 3 has not been recognised.

In line B of FIG. 3, following the successful reading of the code of item 1, the next code is unreadable. By subsequently successfully reading the codes of items 4 and 2, it is possible to infer that the item with the unread code is item 3, even though, in this case, items 2, 3 and 4 have all appeared out of sequence at the station, because the code of item 3 expected within the sequence has not been recognised.

In line C of FIG. 3, the code of item 2, appearing out of sequence, is read successfully. The code of the next item is then unreadable. By subsequently successfully reading the codes of items 3 and 4, it is possible to infer that the item with the unread code is item 1, because the code of item 1 expected within the sequence has not been recognised.

In line D of FIG. 3, the code of item 1 is read successfully. The codes of the next two items are then both unreadable. Subsequently the code of item 2 is read successfully, and it is possible to infer that the items with the unread codes are items 3 and 4, even though they are appearing out of the expected order, because the codes of item 3 and 4 expected within the sequence have not been recognised. In this case, however, because items are appearing out of sequence, it is not possible on the basis of this information alone to infer with any confidence which of the items with unread codes is item 3, and which is item 4. Therefore, in this case, the system also uses the additional information described above, to increase the confidence with which the inference can be made. For example, assuming that the sorting station has the capability to obtain additional information from the item itself, for example relating to its size and/or desired class of service, this information obtained at the sorting station from the two items with unread codes can be compared with the previously stored additional information relating to those two items. If, for example, the two items are of different sizes, it is possible on the basis of this comparison to infer which item is which.

Whether the code of an item has been read directly, in step 53, or inferred by the computer as discussed above, the item is next processed in step 59. For example, in step 59, the routing code, which is a machine-readable form of the destination address, may be printed, if this has not already been done. In addition, the previously printed code, which was found to be unreadable, may be reprinted. As described above, this processing may involve being sent on to a further station within the sorting office. The details of how the item is handled are then stored, for example in the central computer, in association with the code of the item, in step 60. The process then returns to the beginning to receive the next item.

If, at step 58, it is determined that the code cannot be inferred with confidence, for example because it is one of several items with unreadable codes, all appearing together in a group of items out of sequence, which cannot be distinguished on the basis of the stored additional information, the item is rejected at step 61, and sent for manual processing.

There is thus described an arrangement for use in a sorting system, and the process to be used at a sorting station, which can increase the efficiency with which items are sorted. It will be appreciated that, although the invention has been described herein with reference to mail sorting, the invention is applicable to any sorting system, in which codes can be applied to the items to be sorted.

We claim:

1. A sorting system including a plurality of sorting stations, the system comprising means for applying a code to each item; means for storing information relating to the sorting station to which each item is sent; and means for identifying an item, the code on which has been found to be unreadable at a sorting station, using the stored information relating to the items sent to that station.

2. A system as claimed in claim 1, wherein the means for identifying an item uses stored information relating to a sequence of the items sent to that station.

3. A system as claimed in claim 2, wherein the means for identifying an item examines a sequence of readable codes, and identifies the item, the code on which has been found to be unreadable, by reference to the position of the item within that sequence.

4. A system as claimed in claim 1, wherein the means for identifying an item examines a sequence of readable codes on items arriving at the sorting station, and, when the sequence is as expected, identifies the item, the code on which has been found to be unreadable, by reference to the position of the item within that sequence.

5. A system as claimed in claim 4, wherein the means for identifying an item examines a sequence of readable codes on items arriving at the sorting station, and, when the sequence is not as expected, identifies the item, the code on which has been found to be unreadable, by reference to the items expected within that sequence but the codes of which have not been recognised.

6. A system as claimed in claim 1, comprising means for storing additional identifying information about each item, wherein the means for identifying an item uses the stored additional information to assist in identification.

7. A method of sorting items, comprising applying a code to each item; storing information regarding the destinations of each item in the system; and, when a code on an item is found to be unreadable, determining the code by tracing which items have been sent to the station.

8. A method as claimed in claim 7, wherein the step of determining the code uses stored information relating to a sequence of the items sent to that station.

9. A method as claimed in claim 8, wherein the step of determining the code comprises examining a sequence of readable codes, and identifies the code which has been found to be unreadable, by reference to the position of the code within that sequence.

10. A method as claimed in claim 7, wherein the step of determining the code comprises examining a sequence of readable codes on items arriving at the sorting station, and, when the sequence is as expected, identifies the code which has been found to be unreadable, by reference to the position of the code within that sequence.

11. A method as claimed in claim 10, wherein the step of determining the code comprises examining a sequence of readable codes on items arriving at the sorting station, and, when the sequence is not as expected, identifies the code which has been found to be unreadable, by reference to the codes expected within that sequence but which have not been recognised.

12. A method as claimed in claim 1, comprising storing additional identifying information about each item, and using the stored additional information to assist in the determination of the code which has been found to be unreadable.

13. A method as claimed in claim 12, wherein when codes on more than one item are found to be unreadable, and the sequence of readable codes arriving at a sorting station is not as expected, the codes are identified by reference to stored additional identifying information.

* * * * *